US011354957B2

(12) United States Patent
Liao et al.

(10) Patent No.: US 11,354,957 B2
(45) Date of Patent: Jun. 7, 2022

(54) SMART LOCKS UNLOCKING METHODS, MOBILE TERMINALS, SERVERS, AND COMPUTER-READABLE STORAGE MEDIA

(71) Applicant: Advanced New Technologies Co., Ltd., Grand Cayman (KY)

(72) Inventors: Hui Liao, Hangzhou (CN); Qi Huang, Hangzhou (CN); Shengbo Zhao, Hangzhou (CN)

(73) Assignee: Advanced New Technologies Co., Ltd., Grand Cayman (KY)

( * ) Notice: Subject to any disclaimer, the term of this patent is extended or adjusted under 35 U.S.C. 154(b) by 0 days.

(21) Appl. No.: 17/387,774

(22) Filed: Jul. 28, 2021

(65) Prior Publication Data

US 2021/0358246 A1 Nov. 18, 2021

Related U.S. Application Data

(63) Continuation of application No. 17/082,801, filed on Oct. 28, 2020, now Pat. No. 11,113,914, which is a (Continued)

(30) Foreign Application Priority Data

Aug. 31, 2018 (CN) ..... 201811014469.5

(51) Int. Cl.
*G07C 9/26* (2020.01)
*G07C 9/00* (2020.01)

(52) U.S. Cl.
CPC ..... *G07C 9/26* (2020.01); *G07C 9/00309* (2013.01); *G07C 9/00904* (2013.01); *G07C 2009/00436* (2013.01)

(58) Field of Classification Search
None
See application file for complete search history.

(56) References Cited

U.S. PATENT DOCUMENTS 8,806,582 B2 * 8/2014 Dietrich ..... H04L 63/0853 726/4
9,818,247 B2 11/2017 Johnson
(Continued)

FOREIGN PATENT DOCUMENTS

CN 102027511 4/2011
CN 102779323 11/2012
(Continued)

OTHER PUBLICATIONS

Crosby et al., "BlockChain Technology: Beyond Bitcoin," Sutardja Center for Entrepreneurship & Technology Technical Report, Oct. 16, 2015, 35 pages.
(Continued)

*Primary Examiner* — Carlos Garcia
(74) *Attorney, Agent, or Firm* — Fish & Richardson P.C.

(57) ABSTRACT

In an embodiment, a server receives—a digital key request for a digital key to unlock a smart lock. A biometric feature request for collecting a biometric feature from the mobile device is generated and sent to the mobile device. A biometric feature corresponding to the biometric feature request is received. Identity information and a device identifier of the smart lock is received from another server. Based on the identity information, a matching biometric feature stored in a biometric feature database is determined. An identity of a user corresponding to the received biometric feature is verified based on the matching biometric feature. After the identity of the user is verified, smart lock information is identified. A digital key for unlocking the smart lock is generated based on the digital key request and the smart lock information and sent to the mobile device.

20 Claims, 7 Drawing Sheets

Related U.S. Application Data continuation of application No. PCT/CN2019/096482, filed on Jul. 18, 2019.

(56) References Cited

U.S. PATENT DOCUMENTS

| | | | | |
|---|---|---|---|---|
| 10,576,934 | B2 | 3/2020 | Hassan | |
| 2009/0324025 | A1 | 12/2009 | Camp, Jr. et al. | |
| 2015/0199863 | A1 | 7/2015 | Scoggins et al. | |
| 2017/0316533 | A1 | 11/2017 | Goldman-Shenhar et al. | |
| 2019/0051069 | A1 | 2/2019 | Cooley | |
| 2019/0058596 | A1 | 2/2019 | Chang et al. | |
| 2021/0043019 | A1* | 2/2021 | Liao | G07C 9/26 |

FOREIGN PATENT DOCUMENTS

| | | |
|---|---|---|
| CN | 102779329 | 11/2012 |
| CN | 103325164 | 9/2013 |
| CN | 104112306 | 10/2014 |
| CN | 104574599 | 4/2015 |
| CN | 105303670 | 2/2016 |
| CN | 105913132 | 8/2016 |
| CN | 106302547 | 1/2017 |
| CN | 106652109 | 5/2017 |
| CN | 107403496 | 11/2017 |
| CN | 107682339 | 2/2018 |
| CN | 107967741 | 4/2018 |
| CN | 207198935 | 4/2018 |
| CN | 108022181 | 5/2018 |
| CN | 108091012 | 5/2018 |
| CN | 108154575 | 6/2018 |
| CN | 109389712 | 2/2019 |
| EP | 1982241 | 10/2008 |

OTHER PUBLICATIONS

Extended European Search Report in European Application No. 19855024.6, dated Jun. 1, 2021, 11 pages.

Nakamoto, "Bitcoin: A Peer-to-Peer Electronic Cash System," www.bitcoin.org, 2005, 9 pages.

PCT International Preliminary Report on Patentability in International Application No. PCT/CN2019/096482, dated Mar. 2, 2021, 10 pages (with English translation).

PCT International Search Report and Written Opinion in International Application No. PCT/CN2019/096482, dated Oct. 8, 2019, 9 pages (with partial English translation).

* cited by examiner

SMART LOCKS UNLOCKING METHODS, MOBILE TERMINALS, SERVERS, AND COMPUTER-READABLE STORAGE MEDIA

CROSS-REFERENCE TO RELATED APPLICATIONS

This application is a continuation of U.S. application Ser. No. 17/082,801, filed Oct. 28, 2020, which is a continuation of PCT Application No. PCT/CN2019/096482, filed on Jul. 18, 2019, which claims priority to Chinese Patent Application No. 201811014469.5, filed on Aug. 31, 2018, and each application is hereby incorporated by reference in its entirety.

TECHNICAL FIELD

Embodiments of the present specification relate to the field of data processing technologies, and in particular, to smart locks unlocking methods, mobile terminals, servers and computer-readable storage media.

BACKGROUND

With the rise of the short-term rental and guesthouse industry, the legality of tenants is a grey zone of supervision, and is an industry's headache that hinders the compliance of the short-term rental and guesthouse industry and that needs to be urgently solved.

In existing technologies, the tenant makes a room reservation in the application corresponding to the short-term rental and guesthouse. When the tenant arrives at the location of the reserved room within the reservation time, the maintainer of the reserved room gives an unlocking device such as a key or a smart card to the tenant. Then, the tenant uses the unlocking device to open the reserved room, thereby completing the check-in.

SUMMARY

Embodiments of the present specification provide smart locks unlocking methods, mobile terminals, servers and computer-readable storage media, so as to perform remote check-in while ensuring the check-in accuracy, thereby improving user experience.

A first aspect of embodiments of the present specification provides a smart locks unlocking method, where the method is applied to a mobile terminal and includes the following: obtaining a device identifier of the smart lock through wireless communication, and sending the device identifier and its corresponding user identifier to a service server; generating request information of a digital key for unlocking the smart lock, and sending the request information to a processing server; receiving a collection request for collecting biometric feature information that is generated based on the request information and sent by the processing server; collecting corresponding biometric feature information based on the collection request, and sending the corresponding biometric feature information to the processing server; and receiving and storing the digital key for unlocking the smart lock sent by the processing server, and unlocking the smart lock by using the generated digital key, where the digital key is generated by the processing server based on the corresponding biometric feature information, the request information, and identity information corresponding to the user identifier and the device identifier that are sent by the service server.

A second aspect of embodiments of the present specification provides a smart locks unlocking method, where the method is applied to a mobile terminal and includes the following: obtaining a device identifier of the smart lock through wireless communication, and sending the device identifier to a service server; generating request information of a digital key for unlocking the smart lock, and sending the request information to a processing server; receiving a collection request for collecting biometric feature information that is generated based on the request information and sent by the processing server; collecting corresponding biometric feature information based on the collection request, and sending the corresponding biometric feature information to the processing server; and receiving and storing the digital key for unlocking the smart lock sent by the processing server, and unlocking the smart lock by using the generated digital key, where the digital key is generated by the processing server based on the corresponding biometric feature information, the request information, and identity information of a reservation user corresponding to the device identifier that is sent by the service server.

A third aspect of embodiments of the present specification provides a smart locks unlocking method, where the method is applied to a processing server and includes the following: receiving request information of a digital key for unlocking the smart lock sent by a mobile terminal, generating a collection request for collecting biometric feature information based on the request information, and sending the collection request to the mobile terminal; receiving corresponding biometric feature information that is collected based on the collection request and sent by the mobile terminal, where the corresponding biometric feature information is biometric feature information corresponding to the mobile terminal collected by the mobile terminal based on the collection request; receiving identity information corresponding to a user identifier and a device identifier of the smart lock that are sent by a service server, where the identity information corresponding to the user identifier is obtained by the service server from a reservation database based on the received user identifier that is sent by the mobile terminal; the device identifier of the smart lock is obtained by the mobile terminal through wireless communication, and is sent to the service server; the user identifier corresponds to the device identifier; the reservation database is stored in the service server; and identifying matching biometric feature information corresponding to the user identifier from a biometric feature database in the processing server by using the identity information corresponding to the user identifier, and performing user identification for the corresponding biometric feature information based on the matching biometric feature information; when the user identification is successful, identifying, based on the device identifier, smart lock information corresponding to the device identifier from a smart lock database stored in the processing server; generating a digital key for unlocking the smart lock based on the request information and the smart lock information, and sending the generated digital key to the mobile terminal.

A fourth aspect of embodiments of the present specification provides a smart locks unlocking method, where the method is applied to a processing server and includes the following: receiving request information of a digital key for unlocking the smart lock sent by a mobile terminal, generating a collection request for collecting biometric feature information based on the request information, and sending the collection request to the mobile terminal; receiving corresponding biometric feature information that is collected based on the collection request and sent by the mobile terminal; receiving a device identifier of the smart lock and identity information of a reservation user corresponding to the device identifier that are sent by a service server, where the identity information of the reservation user is obtained by the service server from a reservation database based on the received device identifier; the device identifier is obtained by the mobile terminal through wireless communication, and is sent to the service server; the reservation database is stored in the service server; and identifying matching biometric feature information corresponding to the reservation user from a biometric feature database in the processing server by using the identity information of the reservation user, and performing user identification for the corresponding biometric feature information based on the matching biometric feature information; when the user identification is successful, identifying, based on the device identifier, smart lock information corresponding to the device identifier from a smart lock database stored in the processing server; generating a digital key for unlocking the smart lock based on the request information and the smart lock information, and sending the generated digital key to the mobile terminal.

A fifth aspect of embodiments of the present specification further provides a mobile terminal, including the following: a first device identifier acquisition and sending unit, configured to obtain a device identifier of a smart lock through wireless communication, and send the device identifier and its corresponding user identifier to a service server; a first request information generating and sending unit, configured to generate request information of a digital key for unlocking the smart lock, and send the request information to a processing server; a first collection request receiving unit, configured to receive a collection request for collecting biometric feature information that is generated based on the request information and sent by the processing server; a first biometric feature information collecting and sending unit, configured to collect corresponding biometric feature information based on the collection request, and send the corresponding biometric feature information to the processing server; and a first digital key processing unit, configured to receive and store the digital key for unlocking the smart lock sent by the processing server, and unlock the smart lock by using the generated digital key, where the digital key is generated by the processing server based on the corresponding biometric feature information, the request information, and identity information corresponding to the user identifier and the device identifier that are sent by the service server.

A sixth aspect of embodiments of the present specification further provides a processing server, including the following: a first request receiving unit, configured to receive request information of a digital key for unlocking a smart lock sent by a mobile terminal; a first collection request generating and sending unit, configured to generate a collection request for collecting biometric feature information based on the request information, and send the collection request to the mobile terminal; a first biometric feature data receiving unit, configured to receive corresponding biometric feature information that is collected based on the collection request and sent by the mobile terminal, where the corresponding biometric feature information is biometric feature information corresponding to the mobile terminal collected by the mobile terminal based on the collection request; a first information receiving unit, configured to receive identity information corresponding to a user identifier and a device identifier of the smart lock that are sent by a service server, where the identity information corresponding to the user identifier is obtained by the service server from a reservation database based on the received user identifier that is sent by the mobile terminal; the device identifier of the smart lock is obtained by the mobile terminal through wireless communication, and is sent to the service server; the user identifier corresponds to the device identifier; the reservation database is stored in the service server; a first biometric feature data search unit, configured to identify matching biometric feature information corresponding to the user identifier from a biometric feature database in the processing server by using the identity information corresponding to the user identifier; a first user identification unit, configured to perform user identification for the corresponding biometric feature information based on the matching biometric feature information; a first smart lock information acquisition unit, configured to: when the user identification performed by the first user identification unit is successful, identify, based on the device identifier, smart lock information corresponding to the device identifier from a smart lock database stored in the processing server; and a first digital key generating and sending unit, configured to generate a digital key for unlocking the smart lock based on the request information and the smart lock information, and send the generated digital key to the mobile terminal.

A seventh aspect of embodiments of the present specification further provides a mobile terminal, including the following: a second device identifier acquisition and sending unit, configured to obtain a device identifier of a smart lock through wireless communication, and send the device identifier to a service server; a second request information generating and sending unit, configured to generate request information of a digital key for unlocking the smart lock, and send the request information to a processing server; a second collection request receiving unit, configured to receive a collection request for collecting biometric feature information that is generated based on the request information and sent by the processing server; a second biometric feature information collecting and sending unit, configured to collect corresponding biometric feature information based on the collection request, and send the corresponding biometric feature information to the processing server; and a second digital key processing unit, configured to receive and store the digital key for unlocking the smart lock sent by the processing server, and unlock the smart lock by using the generated digital key, where the digital key is generated by the processing server based on the corresponding biometric feature information, the request information, and identity information of a reservation user corresponding to the device identifier that is sent by the service server.

An eighth aspect of embodiments of the present specification further provides a processing server, including the following: a second request receiving unit, configured to receive request information of a digital key for unlocking a smart lock sent by a mobile terminal; a second collection request generating and sending unit, configured to generate a collection request for collecting biometric feature information based on the request information, and send the collection request to the mobile terminal; a second biometric feature data receiving unit, configured to receive corresponding biometric feature information that is collected based on the collection request and sent by the mobile terminal; a second information receiving unit, configured to receive a device identifier of the smart lock and identity information of a reservation user corresponding to the device identifier that are sent by a service server, where the identity information of the reservation user is obtained by the service server from a reservation database based on the received device identifier; the device identifier is obtained by the mobile terminal through wireless communication, and is sent to the service server; the reservation database is stored in the service server; a second biometric feature data search unit, configured to identify matching biometric feature information corresponding to the reservation user from a biometric feature database in the processing server by using the identity information of the reservation user; a second user identification unit, configured to perform user identification for the corresponding biometric feature information based on the matching biometric feature information; a second smart lock information acquisition unit, configured to: when the user identification is successful, identify, based on the device identifier, smart lock information corresponding to the device identifier from a smart lock database stored in the processing server; and a second digital key generating and sending unit, configured to generate a digital key for unlocking the smart lock based on the request information and the smart lock information, and send the generated digital key to the mobile terminal.

A ninth aspect of embodiments of the present specification further provides a smart locks unlocking system, including the following: a mobile terminal, configured to: obtain a device identifier of the smart lock through wireless communication, and send the device identifier and its corresponding user identifier to a service server; generate request information of a digital key for unlocking the smart lock, and send the request information to a processing server; the processing server, configured to receive the request information, generate a collection request for collecting biometric feature information based on the request information, and send the collection request to the mobile terminal, where the mobile terminal is configured to receive the collection request, collect corresponding biometric feature information based on the collection request, and send the corresponding biometric feature information to the processing server; and a service server, configured to: receive the device identifier and the user identifier, and obtain, by using the user identifier, identity information corresponding to the user identifier from a reservation database stored in the service server; and send the identity information corresponding to the user identifier and the device identifier to the processing server, where the reservation database stores the user identifier, the identity information, and its corresponding room reservation information; the processing server is configured to: receive the corresponding biometric feature information, the identity information corresponding to the user identifier, and the device identifier; identify matching biometric feature information corresponding to the user identifier from a biometric feature database in the processing server by using the identity information corresponding to the user identifier, and perform user identification for the corresponding biometric feature information based on the matching biometric feature information; when the user identification is successful, identify, based on the device identifier, smart lock information corresponding to the device identifier from a smart lock database stored in the processing server; generate a digital key for unlocking the smart lock based on the request information and the smart lock information, and send the generated digital key to the mobile terminal; and the mobile terminal is configured to receive and store the generated digital key, and unlock the smart lock by using the generated digital key.

A tenth aspect of embodiments of the present specification further provides a mobile terminal, including a memory, a processor, and a computer program that is stored in the memory and that can be run on the processor, where when executing the program, the processor implements steps of the previous smart locks unlocking method.

An eleventh aspect of embodiments of the present specification further provides a processing server, including a memory, a processor, and a computer program that is stored in the memory and that can run on the processor, where when executing the program, the processor implements steps of the previous smart locks unlocking method.

A twelfth aspect of embodiments of the present specification further provides a computer-readable storage medium, where the computer-readable storage medium stores a computer program, and when being executed by a processor, the program implements steps of the previous smart locks unlocking method.

Some embodiments of the present specification bring the following beneficial effects:

Based on the previous technical solutions, when the mobile terminal unlocks the smart lock, user identification is first performed based on the biometric feature information to identify a tenant. The identification based on the biometric feature information can ensure the check-in accuracy, and after the identification based on the biometric feature information is successful, the digital key is generated and sent to the mobile terminal to complete the unlocking of the smart lock. Remote unlocking is performed while ensuring the check-in accuracy, thereby improving the check-in efficiency and user experience.

DESCRIPTION OF EMBODIMENTS

To better understand the previous technical solutions, the following describes the technical solutions of some embodiments of the present specification in detail with reference to accompanying drawings and specific embodiments. It should be understood that some embodiments of the present specification and the specific features in some embodiments are detailed descriptions of the technical solutions in some embodiments of the present specification, rather than limitations on the technical solutions in the present specification. Some embodiments of the present specification and the technical features in some embodiments can be combined with each other without conflicts.

Figure 1:
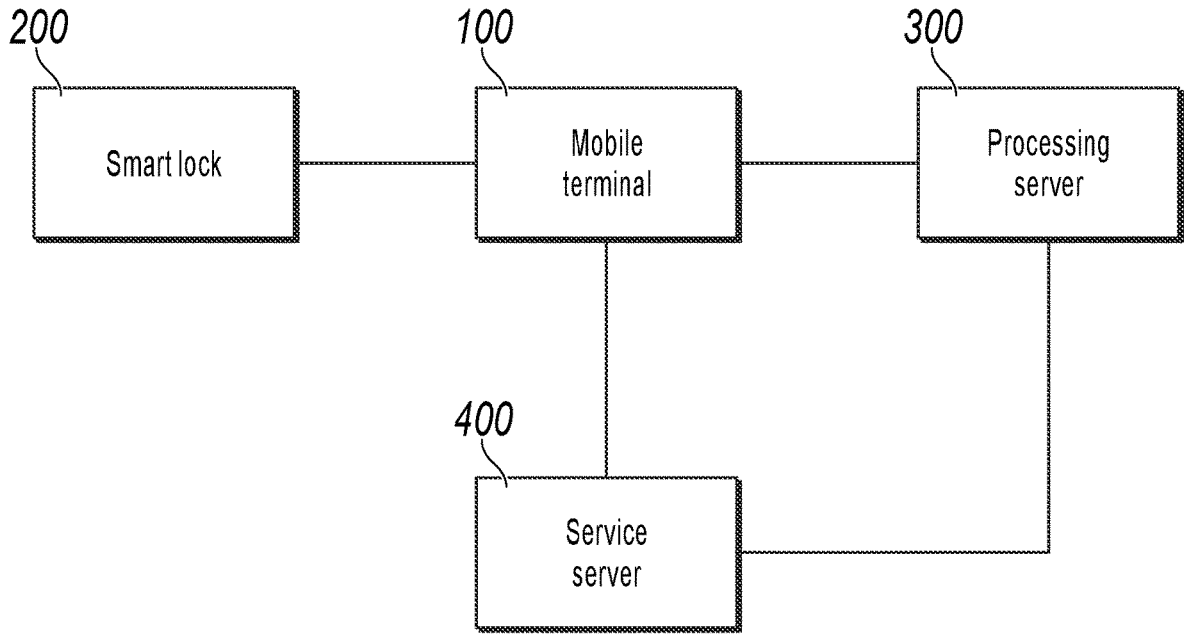
FIG. 1 is a structural diagram illustrating a smart locks unlocking system, according to some embodiments of the present specification.

According to a first aspect, as shown in FIG. 1, embodiments of the present specification provide a smart locks unlocking system, including the following: a mobile terminal 100, configured to: obtain a device identifier of the smart lock 200 through wireless communication, and send the device identifier and its corresponding user identifier to a service server 400; generate request information of a digital key for unlocking the smart lock 200, and send the request information to a processing server 300; the processing server 300, configured to receive the request information, generate a collection request for collecting biometric feature information based on the request information, and send the collection request to the mobile terminal 100, where the mobile terminal 100 is configured to receive the collection request, collect biometric feature information corresponding to the mobile terminal 100 based on the collection request, and send the corresponding biometric feature information to the processing server 300; and a service server 400, configured to: receive the device identifier and the user identifier, and obtain, by using the user identifier, identity information corresponding to the user identifier from a reservation database stored in the service server 400; and send the identity information corresponding to the user identifier and the device identifier to the processing server 300, where the reservation database stores the user identifier, the identity information, and its corresponding room reservation information; the processing server 300 is configured to: receive the corresponding biometric feature information, the identity information corresponding to the user identifier, and the device identifier; identify matching biometric feature information corresponding to the user identifier from a biometric feature database in the processing server 300 by using the identity information corresponding to the user identifier, and perform user identification for the corresponding biometric feature information based on the matching biometric feature information; when the user identification is successful, identify, based on the device identifier, smart lock information corresponding to the device identifier from a smart lock database stored in the processing server 300; generate a digital key for unlocking the smart lock 200 based on the request information and information about the smart lock 200, and send the generated digital key to the mobile terminal 100; and the mobile terminal 100 is configured to receive and store the generated digital key, and unlock the smart lock 200 by using the generated digital key.

In some embodiments of the present specification, the corresponding biometric feature information can be one or more types of biometric information such as fingerprint information, facial feature data, and iris information. Correspondingly, the matching biometric feature information matches the corresponding biometric feature information, that is, the matching biometric feature information includes at least the information contained in the corresponding biometric feature information. For example, when the corresponding biometric feature information is facial feature data, the matching biometric feature information includes at least the facial feature data. One smart lock 200 is installed on each room for rent in the guesthouse and short-term rental. The mobile terminal 100 communicates with the smart lock 200 through wireless communication such as NFC or Bluetooth, so that the mobile terminal 100 can obtain a device identifier of the smart lock 200 through wireless communication. The device identifier can be a MAC address, a device ID, etc. of the device.

In some embodiments of the present specification, before obtaining the device identifier of the smart lock 200, the mobile terminal 100 makes a room reservation in advance and stores reservation information of the room reservation in the mobile terminal 100. The reservation information includes at least location information corresponding to the room for rent, room information of the room for rent, and user information of the tenant. As such, when obtaining the device identifier of the smart lock 200, the mobile terminal 100 extracts the user information of the tenant from the reservation information as the user identifier corresponding to the smart lock 200. The user information of the tenant includes an identity card number of the tenant and/or contact information of the tenant.

In some embodiments of the present specification, the mobile terminal 100 can make a room reservation in advance by using a third-party application that is set in a main application, so that the reservation information is stored in the third-party application corresponding to the room reservation. In such case, the reservation information is stored in the mobile terminal 100. As such, the mobile terminal 100 starts the third-party application corresponding to the room reservation to read the reservation information. The third-party application can be a short-term rental APP or a guesthouse APP. The main application can be ALIPAY or the like. The service server 400 corresponds to the third-party application, and the processing server 300 corresponds to the main application.

In some embodiments of the present specification, the user identifier can also be a registered account of the mobile terminal 100 in the third-party application. Thus, when obtaining the device identifier of the smart lock 200, the mobile terminal 100 starts the third-party application to obtain the registered account of the mobile terminal 100 in the third-party application as the user identifier. Certainly, the user identifier can also be a MAC address and the like of the mobile terminal 100, which is not limited in some embodiments of the present specification. For example, in the following description, the registered account of the mobile terminal 100 in the third-party application is used as the user identifier.

For example, the mobile terminal 100 receives information indicating that a corresponding user A uses a third-party application B1 in an application B to make a room reservation for a room D1 in an inn C. In such case, the reservation information includes A's identity card number, A's contact information, room information of D1 in the inn C, location information of the inn C, and a reservation time. The reservation information is stored in the mobile terminal 100, and B1 can be a guesthouse APP or a short-term rental APP.

Further, if the reservation time is from Jul. 6 to 9, 2018, as such, when the mobile terminal 100 is used for checking in the inn C on Jul. 6, 2018, the mobile terminal 100 obtains, through wireless communication, a device identifier S of the smart lock 200 installed on D1, and then starts the application B1 to obtain a registered account Z1 of the mobile terminal 100 in B1 as the user identifier, that is, obtain the device identifier and its corresponding user identifier, where Z1 corresponds to S. Then, the mobile terminal 100 sends S and Z1 to the service server 400. In addition, after obtaining S, the mobile terminal 100 generates request information Q of a digital key for unlocking the smart lock 200, and sends Q to the processing server 300. The application B can be a guesthouse APP or a short-term rental APP.

In some embodiments of the present specification, after the mobile terminal 100 sends the request information to the processing server 300, the processing server 300 generates a collection request for collecting biometric feature information based on the request information, and sends the collection request to the mobile terminal 100.

The mobile terminal 100 is configured to receive the collection request, collect biometric feature information corresponding to the mobile terminal 100 based on the collection request, and send the corresponding biometric feature information to the processing server 300.

In some embodiments of the present specification, after receiving the collection request, the mobile terminal 100 starts a camera of the mobile terminal based on the collection request, collects a corresponding facial image by using the camera, and extracts facial feature data from the corresponding facial image. Then, the mobile terminal 100 sends the facial feature data as the corresponding biometric feature information to the processing server 300. For example, the camera can be a camera, etc. The matching biometric feature information includes at least facial feature data.

Certainly, when the corresponding biometric feature information is fingerprint information of a corresponding user, after receiving the collection request, the mobile terminal 100 starts a fingerprint collection device based on the collection request, collects the fingerprint information of the corresponding user by using the fingerprint collection device, and sends the fingerprint information of the user as the corresponding biometric feature information to the processing server 300. In such case, the matching biometric feature information includes at least the fingerprint information.

In addition, when the corresponding biometric feature information is iris information of the corresponding user, after receiving the collection request, the mobile terminal 100 starts an iris collection device based on the collection request, collects the iris information of the corresponding user by using the iris collection device, and sends the iris information of the user as the corresponding biometric feature information to the processing server 300. In such case, the matching biometric feature information includes at least the iris information.

Specifically, the facial feature data can be extracted from the corresponding facial image by using a feature point extraction algorithm, and can be used as the corresponding biometric feature information and sent to the processing server 300.

In some embodiments of the present specification, for example, the feature point extraction algorithm can be the Scale-Invariant Feature Transform (SIFT) algorithm, the Speeded Up Robust Features (SURF) algorithm, and the Oriented FAST and Rotated BRIEF (ORB) algorithm, etc., which is not limited in this application.

In other embodiments of the present specification, the processing server 300 can encapsulate an application programming interface (API) corresponding to a collection request for collecting a facial image generated based on the request information into an SDK. The SDK is installed in the main application. As such, the mobile terminal 100 receives the collection request by invoking the API in the SDK.

For example, the mobile terminal 100 is used for checking in the inn C. After obtaining S, the mobile terminal 100 generates request information Q of a digital key for unlocking the smart lock 200, and sends Q to the processing server 300.

In such case, if a collection function is encapsulated into the SDK of the main application, the mobile terminal 100 invokes the API in the SDK to send Q to the processing server 300, and receives the collection request from the processing server 300. Then, the mobile terminal 100 collects A's facial image based on the collection request. After receiving the collection request, the mobile terminal 100 starts a front-facing camera of the mobile terminal 100, collects A's facial image by using the front-facing camera, extracts A's facial feature data from the collected A's facial image by using the ORB algorithm, and sends the extracted A's facial feature data to the processing server 300, so that the processing server 300 performs user identification based on A's facial feature data.

In such case, if the collection function is not encapsulated into the SDK of the main application, after receiving Q, the processing server 300 generates a collection request based on Q, and sends the collection request to the mobile terminal 100. The mobile terminal 100 starts a front-facing camera of the mobile terminal 100 based on the received collection request, collects A's facial image by using the front-facing camera, extracts A's facial feature data from the collected A's facial image by using the ORB algorithm, and sends the extracted A's facial feature data to the processing server 300, so that the processing server 300 performs user identification based on A's facial feature data.

In some embodiments of the present specification, after the mobile terminal 100 sends the device identifier and its corresponding user identifier to the service server 400, the service server 400 receives the device identifier and the user identifier and uses the user identifier. Heretofore, when the mobile terminal 100 makes a room reservation in advance, the reservation information and its corresponding identity information, and the user identifier are stored in a reservation database of the service server 400. Thus, after receiving the device identifier and the user identifier, the service server 400 identifies from the reservation database that the reservation database stores the user identifier, identity information and corresponding room reservation information.

In some embodiments of the present specification, after obtaining the identity information corresponding to the user identifier and the device identifier, the service server 400 sends the identity information corresponding to the user identifier and the device identifier to the processing server 300 for subsequent application for the digital key.

For example, the data stored in the reservation database is shown in Table 1 below:

TABLE 1

| User identifier | Identity card number | Contact information | Reserved room | Reservation time | Inn location |
|---|---|---|---|---|---|
| Z1 | 4210XX | 135XX | D1 in inn C | 2018.7.6-7.9 | Haidian District, Beijing |
| Z2 | 4211XX | 136XX | D13 in inn C1 | 2018.6.3-6.10 | Jing'an District, Shanghai |

TABLE 1-continued

| User identifier | Identity card number | Contact information | Reserved room | Reservation time | Inn location |
|---|---|---|---|---|---|
| Z3 | 4212XX | 138XX | D22 in inn C2 | 2018.4.5-5.10 | Wuhou District, Chengdu |

In Table 1, the reserved room, the reservation time, and the inn location are the room reservation information in the reservation database; the identity card number is the identity information in the reservation database; and the contact information is the contact information of the tenant in the reservation database.

For example, the mobile terminal 100 is used for checking in the inn C. The mobile terminal 100 obtains, through wireless communication, a device identifier S of the smart lock 200 installed on D1, then starts the application B1 to obtain a registered account Z1 of the mobile terminal 100 in B1, and then sends S and Z1 to the service server 400.

After receiving S and Z1, the service server 400 uses Z1 to identify from Table 1 that the corresponding identity information is the identity card number 4210XX, and then sends 4210XX and S to the processing server 300.

In some embodiments of the present specification, after receiving the corresponding biometric feature information, the identity information corresponding to the user identifier, and the device identifier, the processing server 300 firstly performs user identification by using the corresponding biometric feature information and the identity information corresponding to the user identifier; when the user identification is successful, the processing server 300 generates a digital key for unlocking the smart lock 200 based on the device identifier, and sends the digital key to the mobile terminal 100, so that the mobile terminal 100 unlocks the smart lock 200 by using the digital key, thereby completing a user check-in process.

In some embodiments, the biometric feature database in the processing server 300 stores each corresponding biometric feature information for making a room reservation. Biometric feature information of each corresponding user can be collected when or before the user makes a reservation, and be stored in the biometric feature database. Alternatively, each corresponding biometric feature information can be collected by a large number of mobile terminals 100, and then be stored in the biometric feature database, which is not limited in the present specification.

In some embodiments of the present specification, when the corresponding biometric feature information is facial feature data, the biometric feature database stores at least facial feature data, so that matching facial feature data can be identified from the biometric feature database. In such case, the matching facial feature data serves as the matching biometric feature information. Similarly, when the corresponding biometric feature information is fingerprint information and iris information, the biometric feature database stores at least fingerprint information and iris information, so that matching fingerprint information and matching iris information can be identified from the biometric feature database. In such case, the matching fingerprint information and the matching iris information serve as the matching biometric feature information.

In some embodiments of the present specification, when user identification is performed for the corresponding biometric feature information based on the matching biometric feature information, the matching biometric feature information and the corresponding biometric feature information are matched to obtain a matching similarity; it is detected whether the matching similarity is not less than a predetermined threshold, and a detection result is obtained; and the user identification is performed by using the detection result.

In the following description, for example, the matching biometric feature information is matching facial feature data. The biometric feature database stores at least identity information and facial feature data of each corresponding user, which can be specifically shown in Table 2 below:

TABLE 2

| Identity card number | Facial feature data (denoted by M) |
|---|---|
| 4210XX | M1 |
| 4211XX | M2 |
| 4211XX | M3 |
| 4311XX | M4 |
| 4313XX | M5 |

In some embodiments of the present specification, when the corresponding biometric feature information is facial feature data and the matching biometric feature information is matching facial feature data, the processing server 300 identifies, when performing user identification, matching facial feature data corresponding to the user identifier from the biometric feature database by using the received identity information corresponding to the user identifier; performs feature point matching on the matching facial feature data set and the received facial feature data to obtain a matching similarity; detects whether the matching similarity is not less than a predetermined threshold, and obtains a detection result; and performs the user identification by using the detection result. If the detection result indicates that the matching similarity is not less than the predetermined threshold, it is determined that the user identification is successful, and then a next process of generating and delivering the digital key is performed. If the detection result indicates the matching similarity is less than the predetermined threshold, it is determined that the user identification fails, and then a user identification failure is returned to the mobile terminal 100, and generation of the digital key is prohibited.

As such, whether the digital key is generated is determined through user identification, thereby ensuring the accuracy of generating the digital key, reducing the probability that a person other than the tenant unlocks the smart lock 200 by using the digital key, and improving the check-in security.

In some embodiments of the present specification, the predetermined threshold can be set by a server or can be set manually. To further improve the check-in security, the predetermined threshold is usually set to a value not less than 95% and not greater than 1, for example, 95%, 98%, 99%, etc. Certainly, the predetermined threshold can also be set to a value less than 95%, for example, 90%, 85%, etc., which is not limited in the present specification.

For example, the mobile terminal 100 is used for checking in the inn C and the corresponding biometric feature information is facial feature data. After receiving the identity card number 4210XX and S delivered by the service server 400, and the collected A's facial feature data sent by the mobile terminal 100, the processing server 300 first identifies, based on 4210XX, from Table 2 that the corresponding facial feature data is M1, that is, M1 is the matching facial feature data. Then, the processing server 300 performs user identification for A's facial feature data based on M1.

When user identification is performed for the extracted A's facial feature data based on M1, feature point matching is performed on M1 and the extracted A's facial feature data to obtain a matching similarity of 97%, and it is detected whether the matching similarity is not less than a predetermined threshold. In such case, if the predetermined threshold is 95%, because 97%>95%, the obtained detection result indicates that the matching similarity is not less than the predetermined threshold, and the user identification is successful. If the predetermined threshold is 99%, because 99%>97%, the matching similarity is less than the predetermined threshold, and the user identification fails. In such case, a user identification failure is returned to the mobile terminal 100, and generation of the digital key is prohibited.

For example, the mobile terminal 100 is used for checking in the inn C and the corresponding biometric feature information is fingerprint information. After receiving the identity card number 4210XX and S delivered by the service server 400, and the collected A's fingerprint information sent by the mobile terminal 100, the processing server 300 first identifies matching fingerprint information corresponding to A from Table 2 based on 4210XX, that is, the matching fingerprint information corresponding to A serves as the matching biometric feature information. Then, the processing server 300 performs user identification for A's fingerprint information based on the matching fingerprint information corresponding to A.

When user identification is performed for A's fingerprint information based on the matching fingerprint information corresponding to A, a matching similarity between the matching fingerprint information corresponding to A and A's fingerprint information is obtained, and the obtained matching similarity is 98%. It is detected whether the matching similarity is not less than a predetermined threshold. In such case, if the predetermined threshold is 95%, because 98%>95%, the obtained detection result indicates that the matching similarity is not less than the predetermined threshold, and the user identification is successful. If the predetermined threshold is 99%, because 99%>98%, the matching similarity is less than the predetermined threshold, and the user identification fails. In such case, a user identification failure is returned to the mobile terminal 100, and generation of the digital key is prohibited.

In some embodiments of the present specification, when the user identification is successful, the processing server 300 responds to the request information and first identifies smart lock information corresponding to the device identifier from the smart lock database based on the device identifier. The smart lock database stores a device identifier and smart lock information of each smart lock, and the smart lock information can be a method for generating a digital key for each smart lock. After obtaining the smart lock information, the processing server 300 generates the digital key, and sends the digital key to the mobile terminal 100.

In some embodiments of the present specification, the digital key is encrypted data that needs to be exchanged and transferred with the smart lock 200 when the smart lock is unlocked.

For example, when the user identification performed by the processing server 300 is successful, the processing server 300 identifies, based on the device identifier, smart lock information corresponding to the device identifier from the smart lock database stored in the processing server 300; and generates a digital key for unlocking the smart lock 200 based on the request information and the smart lock information corresponding to the device identifier, and sends the generated digital key to the mobile terminal 100. The mobile terminal 100 is configured to receive and store the digital key, and unlock the smart lock 200 by using the digital key, thereby completing check-in.

As such, in some embodiments of the present specification, after the user identification is successful, the digital key is generated and delivered. Performing user identification can ensure the check-in accuracy. Delivering the digital key to the mobile terminal 100 for check-in, that is, performing remote check-in while ensuring the check-in accuracy, can improve the check-in efficiency and user experience.

In other embodiments of the present specification, the processing server 300 further includes a smart lock server. The smart lock database is stored in the smart lock server. When the user identification is successful, the processing server 300 responds to the request information, and sends the device identifier and the request information to the smart lock server. The smart lock server is configured to: receive the device identifier and the request information, identify smart lock information corresponding to the device identifier from the smart lock database, generate the digital key based on the request information, and send the digital key to the processing server 300. The processing server 300 delivers the received digital key to the mobile terminal 100. The mobile terminal 100 locally stores the digital key, and then unlocks the smart lock 200 by using the digital key, thereby completing check-in.

In other embodiments of the present specification, when the service server 400 sends the identity information corresponding to the user identifier and the device identifier to the processing server 300, the service server 400 can further obtain a reservation time corresponding to the user identifier from the reservation database based on the user identifier, and send the reservation time to the processing server 300, so that the processing server 300 receives the reservation time, and determines, after the user identification is successful and when the digital key for unlocking the smart lock is generated, a validity period of the generated digital key based on the reservation time.

Because the processing server 300 generates the validity period based on the reservation time, the validity period of the digital key matches the reservation time. As such, the digital key is invalid when it is not within the reservation time, and the invalid digital key cannot unlock the smart lock 200, thereby reducing the probability that the smart lock 200 is unlocked by multiple tenants.

For example, in Table 1, after receiving S and Z1, the service server 400 uses Z1 to identify from Table 1 that the corresponding identity information is the identity card number 4210XX and the reservation time is 2018.7.6-7.9, and then sends 4210XX, S, and 2018.7.6-7.9 to the processing server 300, so that when generating a digital key for unlocking the smart lock 200, the processing server 300 determines the validity period of the digital key to be 2018.7.6 12:00 pm to 2018.7.9 12:00 pm. The digital key can unlock the smart lock 200 when the digital key is within the validity period. The digital key cannot unlock the smart lock 200 when the digital key is not within the validity period.

Figure 2:
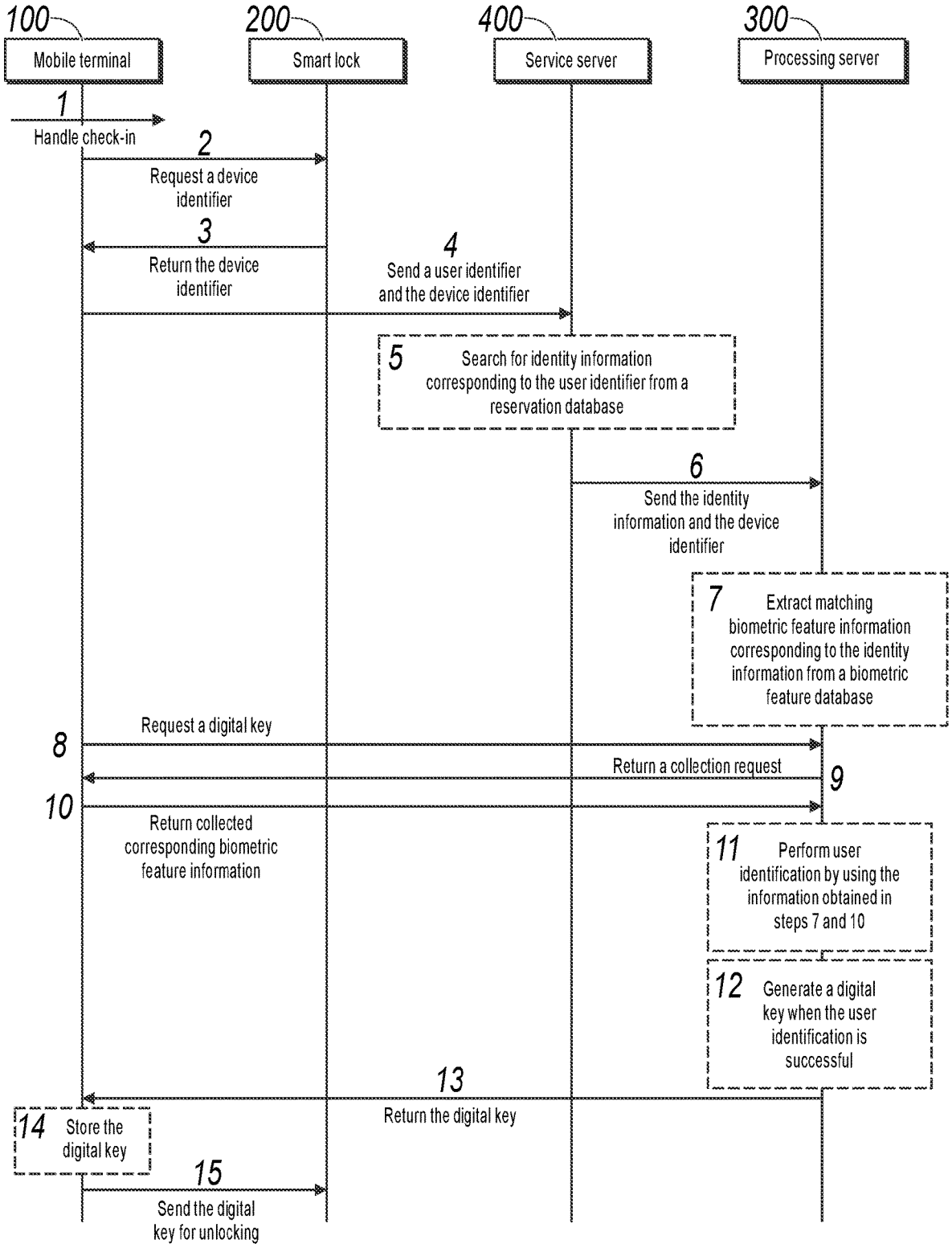
FIG. 2 is a first execution flowchart illustrating a smart locks unlocking system, according to some embodiments of the present specification.

A specific execution process of a smart locks unlocking system in some embodiments of the present specification is shown in FIG. 2. A mobile terminal 100 first performs step 1 of handling check-in and starting a third-party application in the main application to obtain a user identifier; and then performs step 2 of requesting a device identifier of a smart lock 200.

After receiving the request for the device identifier, the smart lock 200 performs step 3 of returning the device identifier.

In some embodiments of the present specification, after receiving the device identifier, the mobile terminal 100 can perform step 4 and step 8 at the same time, or can perform step 4 before step 8, or can perform step 8 before step 4, which is not limited in the present specification. In the following description, for example, step 4 is performed before step 8.

The mobile terminal 100 performs step 4 of sending a user identifier and a device identifier to a service server 400. After receiving the information sent in step 4, the service server 400 performs step 5 of searching for identity information corresponding to the user identifier from a reservation database, and after identifying the identity information, performs step 6 of sending the identity information and the device identifier to the processing server 300 for use by the processing server 300 during subsequent user identification. After receiving the information sent by the service server 400, the processing server 300 performs step 7 of extracting matching biometric feature information corresponding to the identity information from a biometric feature database.

After performing step 4, the mobile terminal 100 performs step 8 of requesting a digital key from the processing server 300. After receiving the request information sent in step 8, the processing server 300 performs step 9 of returning a collection request to the mobile terminal 100. After receiving the collection request, the mobile terminal 100 performs step 10 of responding to the collection request and returning collected corresponding biometric feature information.

In such case, after receiving the corresponding biometric feature information returned in steps 7 and 10, the processing server 300 performs step 11 of performing user identification by using the biometric feature information obtained in steps 7 and 10; when the user identification is successful, performs step 12 of generating a digital key; and after generating the digital key, performs step 13 of returning the digital key to the mobile terminal 100. After receiving the digital key, the mobile terminal 100 performs step 14 of storing the digital key, and then performs step 15 of sending the digital key to the smart lock 200, thereby unlocking the smart lock 200 and completing check-in.

In some embodiments of the present specification, during check-in, user identification is first performed based on the biometric feature information to identify the tenant. The identification based on the biometric feature information can accurately identify the tenant. It can be understood that, the identification based on the biometric feature information ensures the check-in accuracy, and after the identification based on the biometric feature information is successful, the digital key is generated and sent to the mobile terminal 100 for check-in, that is, remote check-in is performed while ensuring the check-in accuracy, thereby improving the check-in efficiency and user experience.

Figure 3:
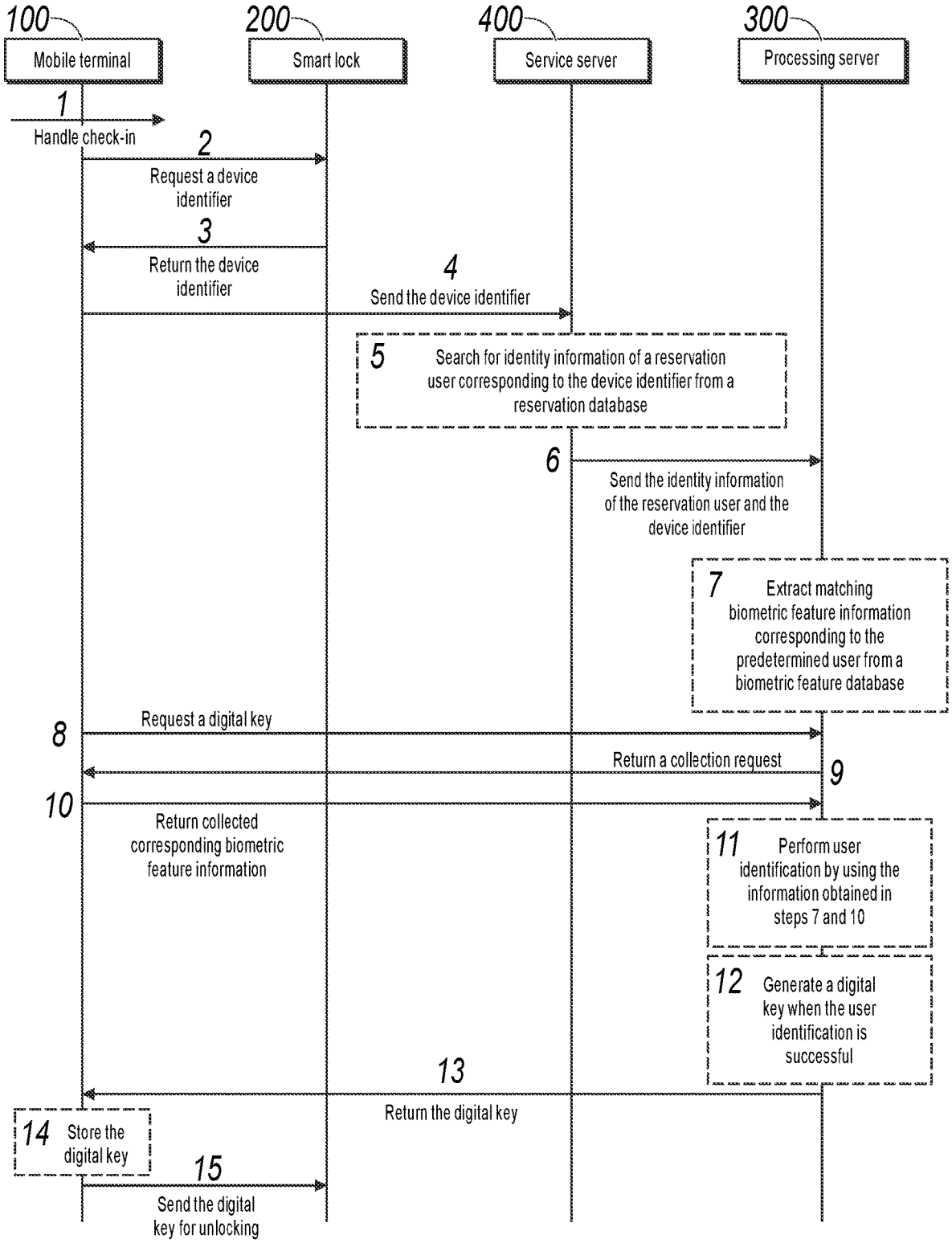
FIG. 3 is a second execution flowchart illustrating a smart locks unlocking system, according to some embodiments of the present specification.

According to a second aspect, as shown in FIG. 1 and FIG. 3, some embodiments of the present specification provide a smart locks unlocking system, including the following: a mobile terminal 100, configured to: obtain a device identifier of the smart lock 200 through wireless communication, and send the device identifier to a service server 400; generate request information of a digital key for unlocking the smart lock 200, and send the request information to a processing server 300; the processing server 300, configured to receive the request information, generate a collection request for collecting biometric feature information based on the request information, and send the collection request to the mobile terminal 100, where the mobile terminal 100 is configured to receive the collection request, collect biometric feature information corresponding to the mobile terminal 100 based on the collection request, and send the corresponding biometric feature information to the processing server 300; and the service server 400, configured to: receive the device identifier, and obtain, by using the device identifier, identity information of a reservation user corresponding to the device identifier from a reservation database stored in the service server 400; and send the identity information of the reservation user and the device identifier to the processing server 300, where the reservation database stores the device identifier, the identity information of the reservation user, and its corresponding room reservation information; the processing server 300 is configured to: receive the corresponding biometric feature information, the identity information of the reservation user, and the device identifier; identify matching biometric feature information corresponding to the reservation user from a biometric feature database in the processing server 300 by using the identity information of the reservation user, and perform user identification for the corresponding biometric feature information based on the matching biometric feature information; when the user identification is successful, identify, based on the device identifier, smart lock information corresponding to the device identifier from a smart lock database stored in the processing server 300; generate a digital key for unlocking the smart lock 200 based on the request information and information about the smart lock 200, and send the generated digital key to the mobile terminal 100; and the mobile terminal 100 is configured to receive and store the generated digital key, and unlock the smart lock 200 by using the generated digital key.

A specific execution process of a smart locks unlocking system in some embodiments of the present specification is shown in FIG. 3. A mobile terminal 100 first performs step 1 of handling check-in; and then performs step 2 of requesting a device identifier of a smart lock 200.

After receiving the request for the device identifier, the smart lock 200 performs step 3 of returning the device identifier.

In some embodiments of the present specification, after receiving the device identifier, the mobile terminal 100 can perform step 4 and step 8 at the same time, or can perform step 4 before step 8, or can perform step 8 before step 4, which is not limited in the present specification. In the following description, for example, step 4 is performed before step 8.

The mobile terminal 100 performs step 4 of sending a device identifier to a service server 400. After receiving the information sent in step 4, the service server 400 performs step 5 of searching for identity information of a reservation user corresponding to the device identifier from a reservation database, and after identifying the identity information of the reservation user, performs step 6 of sending the identity information of the reservation user and the device identifier to the processing server 300 for use by the processing server 300 during subsequent user identification. After receiving the information sent by the service server 400, the processing server 300 performs step 7 of extracting matching biometric feature information corresponding to the reservation user from a biometric feature database.

After performing step 4, the mobile terminal 100 performs step 8 of requesting a digital key from the processing server 300. After receiving the request information sent in step 8, the processing server 300 performs step 9 of returning a collection request to the mobile terminal 100. After receiving the collection request, the mobile terminal 100 performs step 10 of responding to the collection request and returning collected corresponding biometric feature information.

In such case, after receiving the corresponding biometric feature information returned in steps 7 and 10, the processing server 300 performs step 11 of performing user identification by using the biometric feature information obtained in steps 7 and 10; when the user identification is successful, performs step 12 of generating a digital key; and after generating the digital key, performs step 13 of returning the digital key to the mobile terminal 100. After receiving the digital key, the mobile terminal 100 performs step 14 of storing the digital key, and then performs step 15 of sending the digital key to the smart lock 200, thereby unlocking the smart lock 200 and completing check-in.

The unlocking system provided in the second aspect differs from the unlocking system provided in the first aspect in that: First, the reservation database in the second aspect stores the device identifier, the identity information of the reservation user and the corresponding room reservation information; the reservation database in the first aspect stores the user identifier, the identity information, and corresponding room reservation information. Second, the mobile terminal 100 in the second aspect does not need to send the user identifier, whereas the mobile terminal 100 in the first aspect needs to send the user identifier. In addition to the previous differences, for other implementation processes of the unlocking system provided in the second aspect, references can be made to the specific implementation processes of the unlocking system provided in the first aspect. For brevity of the specification, details are omitted here for simplicity.

Specifically, because the reservation database in the second aspect stores the device identifier, the identity information of the reservation user and the corresponding room reservation information, as such, the service server 400 can obtain the identity information of the reservation user corresponding to the device identifier, and the corresponding room reservation information only based on the received device identifier sent by the mobile terminal 100.

According to a third aspect, based on the same technical concept as the first aspect, some embodiments of the present specification provide a smart locks unlocking method, where the method is applied to a mobile terminal and includes the following:

S302: Obtain a device identifier of the smart lock through wireless communication, and send the device identifier and its corresponding user identifier to a service server; generate request information of a digital key for unlocking the smart lock, and send the request information to a processing server.

S304: Receive a collection request for collecting biometric feature information that is generated based on the request information and sent by the processing server; collect corresponding biometric feature information based on the collection request, and send the corresponding biometric feature information to the processing server.

S306: Receive and store the digital key for unlocking the smart lock sent by the processing server, and unlock the smart lock by using the generated digital key, where the digital key is generated by the processing server based on the corresponding biometric feature information, the request information, and identity information corresponding to the user identifier and the device identifier that are sent by the service server.

In some implementations of the present specification, the collecting of corresponding biometric feature information based on the collection request specifically includes the following: starting a camera of the mobile terminal based on the collection request, collecting a corresponding facial image by using the camera, and extracting facial feature data from the corresponding facial image.

In some implementations of the present specification, the extracting of the facial feature data from the corresponding biometric feature information specifically includes the following: extracting the facial feature data from the corresponding biometric feature information by using a feature point extraction algorithm.

According to a fourth aspect, based on the same technical concept as the first aspect, some embodiments of the present specification provide a smart locks unlocking method, where the method is applied to a processing server and includes the following:

S402: Receive request information of a digital key for unlocking the smart lock sent by a mobile terminal, generate a collection request for collecting biometric feature information based on the request information, and send the collection request to the mobile terminal.

S404: Receive corresponding biometric feature data that is obtained based on the collection request and sent by the mobile terminal, where the corresponding biometric feature information is biometric feature information corresponding to the mobile terminal collected by the mobile terminal based on the collection request.

S406: Receive identity information corresponding to a user identifier and a device identifier of the smart lock that are sent by a service server, where the identity information corresponding to the user identifier is obtained by the service server from a reservation database based on the received user identifier that is sent by the mobile terminal; the device identifier of the smart lock is obtained by the mobile terminal through wireless communication, and is sent to the service server; the user identifier corresponds to the device identifier; the reservation database is stored in the service server.

S408: Identify matching biometric feature information corresponding to the user identifier from a biometric feature database in the processing server by using the identity information corresponding to the user identifier, and perform user identification for the corresponding biometric feature information based on the matching biometric feature information; when the user identification is successful, identify, based on the device identifier, smart lock information corresponding to the device identifier from a smart lock database stored in the processing server; generate a digital key for unlocking the smart lock based on the request information and the smart lock information, and send the generated digital key to the mobile terminal.

In some implementations of the present specification, when generating the digital key for unlocking the smart lock based on the request information and the smart lock information, the method further includes the following: receiving a reservation time corresponding to the user identifier that is obtained from the reservation database and sent by the service server, and determining a validity period of the generated digital key based on the reservation time.

In some implementations of the present specification, when generating the digital key for unlocking the smart lock based on the request information and the smart lock information, the method further includes the following: receiving a reservation time corresponding to the user identifier that is obtained from the reservation database and sent by the service server, and determining a validity period of the generated digital key based on the reservation time.

In some implementations of the present specification, the performing of user identification for the corresponding biometric feature information based on the matching biometric feature information specifically includes the following: when the corresponding biometric feature information is facial feature data and the matching biometric feature information is matching facial feature data, performing feature point matching on the matching facial feature data and the facial feature data to obtain a matching similarity; detecting whether the matching similarity is not less than a predetermined threshold, and obtaining a detection result; and performing the user identification by using the detection result.

According to a fifth aspect, based on the same technical concept as the second aspect, some embodiments of the present specification provide a smart locks unlocking method, where the method is applied to a mobile terminal and includes the following:

S502: Obtain a device identifier of the smart lock through wireless communication, and send the device identifier to a service server; generate request information of a digital key for unlocking the smart lock, and send the request information to a processing server.

S504: Receive a collection request for collecting biometric feature information that is generated based on the request information and sent by the processing server; collect corresponding biometric feature information based on the collection request, and send the corresponding biometric feature information to the processing server.

S506: Receive and store the digital key for unlocking the smart lock sent by the processing server, and unlock the smart lock by using the generated digital key, where the digital key is generated by the processing server based on the corresponding biometric feature information, the request information, and identity information of a reservation user corresponding to the device identifier that is sent by the service server.

In some implementations of the present specification, the collecting of corresponding biometric feature information based on the collection request specifically includes the following: starting a camera of the mobile terminal based on the collection request, collecting a corresponding facial image by using the camera, and extracting facial feature data from the corresponding facial image, where the facial feature data serves as the corresponding biometric feature information.

In some implementations of the present specification, the extracting of facial feature data from the corresponding facial image specifically includes the following: extracting the facial feature data from the corresponding facial image by using a feature point extraction algorithm.

According to a sixth aspect, based on the same technical concept as the second aspect, some embodiments of the present specification provide a smart locks unlocking method, where the method is applied to a processing server and includes the following:

S602: Receive request information of a digital key for unlocking the smart lock sent by a mobile terminal, generate a collection request for collecting biometric feature information based on the request information, and send the collection request to the mobile terminal.

S604: Receive corresponding biometric feature information that is collected based on the collection request and sent by the mobile terminal.

S606: Receive a device identifier of the smart lock and identity information of a reservation user corresponding to the device identifier that are sent by a service server, where the identity information of the reservation user is obtained by the service server from a reservation database based on the received device identifier; the device identifier is obtained by the mobile terminal through wireless communication, and is sent to the service server; the reservation database is stored in the service server.

S608: Identify matching biometric feature information corresponding to the reservation user from a biometric feature database in the processing server by using the identity information of the reservation user, and perform user identification for the corresponding biometric feature information based on the matching biometric feature information; when the user identification is successful, identify, based on the device identifier, smart lock information corresponding to the device identifier from a smart lock database stored in the processing server; generate a digital key for unlocking the smart lock based on the request information and the smart lock information, and send the generated digital key to the mobile terminal.

In some implementations of the present specification, when generating the digital key for unlocking the smart lock based on the request information and the smart lock information, the method further includes the following: receiving a reservation time corresponding to the reservation user that is obtained from the reservation database and sent by the service server, and determining a validity period of the generated digital key based on the reservation time.

In some implementations of the present specification, the performing of user identification for the corresponding biometric feature information based on the matching biometric feature information specifically includes the following: when the corresponding biometric feature information is facial feature data and the matching biometric feature information is matching facial feature data, performing feature point matching on the matching facial feature data and the facial feature data to obtain a matching similarity; detecting whether the matching similarity is not less than a predetermined threshold, and obtaining a detection result; and performing the user identification by using the detection result.

Figure 4:
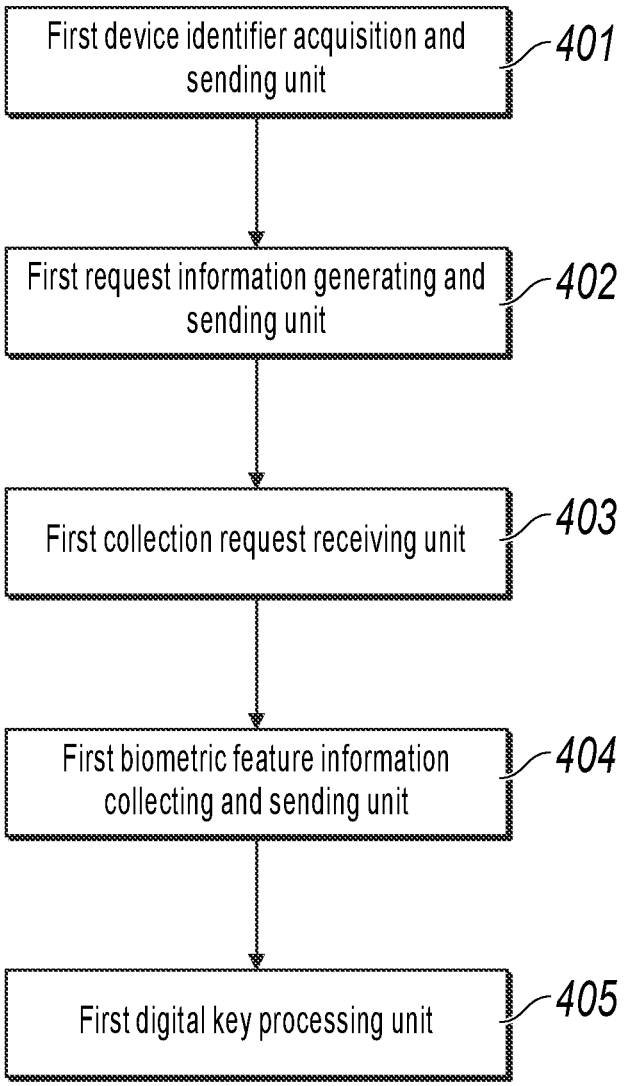
FIG. 4 is a first schematic structural diagram illustrating a mobile terminal, according to some embodiments of the present specification.

According to a sixth aspect, based on the same technical concept as the first aspect, some embodiments of the present specification provide a mobile terminal, as shown in FIG. 4, including the following: a first device identifier acquisition and sending unit 401, configured to obtain a device identifier of a smart lock through wireless communication, and send the device identifier and its corresponding user identifier to a service server; a first request information generating and sending unit 402, configured to generate request information of a digital key for unlocking the smart lock, and send the request information to a processing server; a first collection request receiving unit 403, configured to receive a collection request for collecting biometric feature information that is generated based on the request information and sent by the processing server; a first biometric feature information collecting and sending unit 404, configured to collect corresponding biometric feature information based on the collection request, and send the corresponding biometric feature information to the processing server; and a first digital key processing unit 405, configured to receive and store the digital key for unlocking the smart lock sent by the processing server, and unlock the smart lock by using the generated digital key, where the digital key is generated by the processing server based on the corresponding biometric feature information, the request information, and identity information corresponding to the user identifier and the device identifier that are sent by the service server.

In some implementations of the present specification, the first biometric feature information collecting and sending unit 404 is specifically configured to start a camera of the mobile terminal based on the collection request, collect a corresponding facial image by using the camera, and extract facial feature data from the corresponding facial image.

In some implementations of the present specification, the first biometric feature information collecting and sending unit 404 is specifically configured to extract the facial feature data from the corresponding facial image by using a feature point extraction algorithm.

Figure 5:
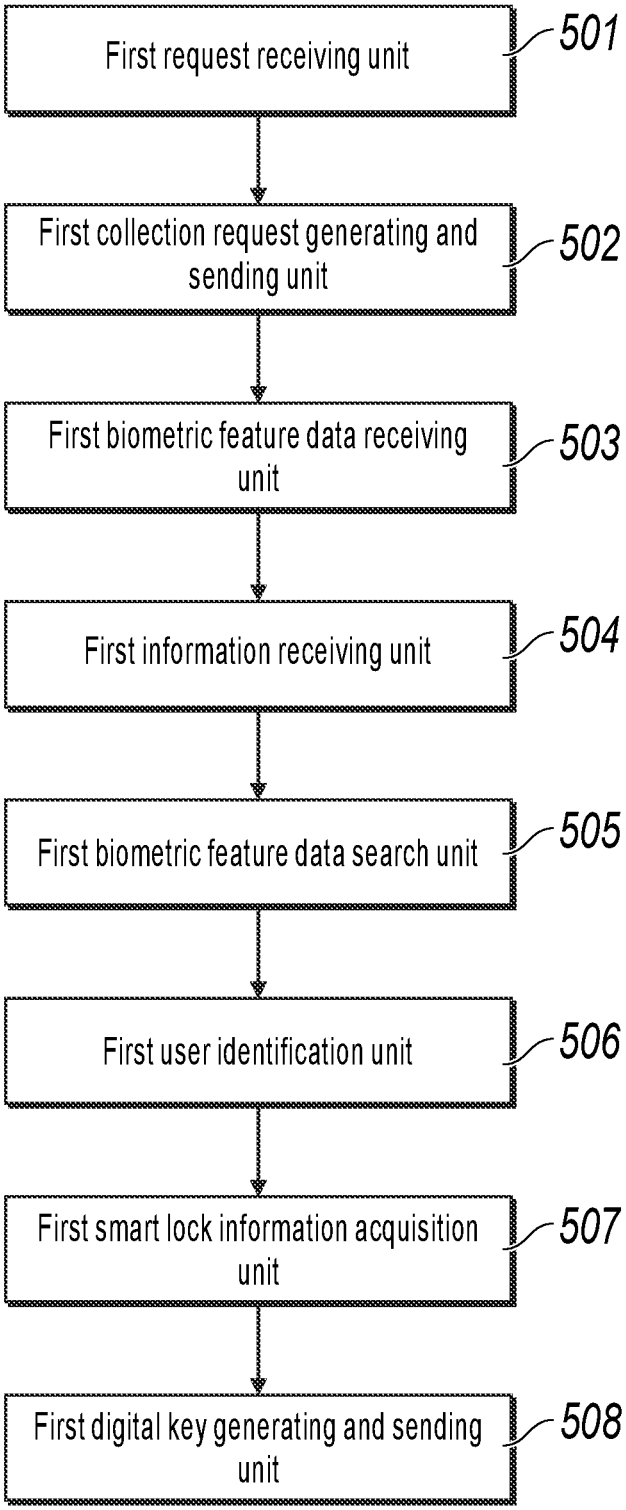
FIG. 5 is a first schematic structural diagram illustrating a processing server, according to some embodiments of the present specification.

According to a seventh aspect, based on the same technical concept as the first aspect, some embodiments of the present specification provide a processing server, as shown in FIG. 5, including the following: a first request receiving unit 501, configured to receive request information of a digital key for unlocking a smart lock sent by a mobile terminal; a first collection request generating and sending unit 502, configured to generate a collection request for collecting biometric feature information based on the request information, and send the collection request to the mobile terminal; a first biometric feature data receiving unit 503, configured to receive corresponding biometric feature information that is obtained based on the collection request and sent by the mobile terminal, where the corresponding biometric feature information is biometric feature information corresponding to the mobile terminal collected by the mobile terminal based on the collection request; a first information receiving unit 504, configured to receive identity information corresponding to a user identifier and a device identifier of the smart lock that are sent by a service server, where the identity information corresponding to the user identifier is obtained by the service server from a reservation database based on the received user identifier that is sent by the mobile terminal; the device identifier of the smart lock is obtained by the mobile terminal through wireless communication, and is sent to the service server; the user identifier corresponds to the device identifier; the reservation database is stored in the service server; a first biometric feature data search unit 505, configured to identify matching biometric feature information corresponding to the user identifier from a biometric feature database in the processing server by using the identity information corresponding to the user identifier; a first user identification unit 506, configured to perform user identification for the corresponding biometric feature information based on the matching biometric feature information; a first smart lock information acquisition unit 507, configured to: when the user identification performed by the first user identification unit 506 is successful, identify, based on the device identifier, smart lock information corresponding to the device identifier from a smart lock database stored in the processing server; and a first digital key generating and sending unit 508, configured to generate a digital key for unlocking the smart lock based on the request information and the smart lock information, and send the generated digital key to the mobile terminal.

In some implementations of the present specification, the processing server further includes the following: a first reservation time receiving unit, configured to: after the digital key for unlocking the smart lock is generated based on the request information and the smart lock information, receive a reservation time corresponding to the user identifier that is obtained from the reservation database and sent by the service server; and a first validity period generating unit, configured to determine a validity period of the generated digital key based on the reservation time.

In some implementations of the present specification, the first user identification unit 506 is specifically configured to: when the corresponding biometric feature information is facial feature data and the matching biometric feature information is matching facial feature data, perform feature point matching on the matching facial feature data and the facial feature data to obtain a matching similarity; detect whether the matching similarity is not less than a predetermined threshold, and obtain a detection result; and perform the user identification by using the detection result.

According to an eighth aspect, based on the same technical concept as the second aspect, some embodiments of the present specification provide a mobile terminal, including the following: a second device identifier acquisition and sending unit, configured to obtain a device identifier of a smart lock through wireless communication, and send the device identifier to a service server; a second request information generating and sending unit, configured to generate request information of a digital key for unlocking the smart lock, and send the request information to a processing server; a second collection request receiving unit, configured to receive a collection request for collecting biometric feature information that is generated based on the request information and sent by the processing server; a second biometric feature information collecting and sending unit, configured to collect corresponding biometric feature information based on the collection request, and send the corresponding biometric feature information to the processing server; and a second digital key processing unit, configured to receive and store the digital key for unlocking the smart lock sent by the processing server, and unlock the smart lock by using the generated digital key, where the digital key is generated by the processing server based on the corresponding biometric feature information, the request information, and identity information of a reservation user corresponding to the device identifier that is sent by the service server.

In some implementations of the present specification, the second biometric feature information collecting and sending unit is configured to start a camera of the mobile terminal based on the collection request, collect a corresponding facial image by using the camera, and extract facial feature data from the corresponding facial image, where the facial feature data serves as the corresponding biometric feature information.

In some implementations of the present specification, the second biometric feature information collecting and sending unit is specifically configured to extract the facial feature data from the corresponding facial image by using a feature point extraction algorithm.

According to a ninth aspect, based on the same technical concept as the second aspect, some embodiments of the present specification provide a processing server, including the following: a second request receiving unit, configured to receive request information of a digital key for unlocking a smart lock sent by a mobile terminal; a second collection request generating and sending unit, configured to generate a collection request for collecting biometric feature information based on the request information, and send the collection request to the mobile terminal; a second biometric feature data receiving unit, configured to receive corresponding biometric feature information that is collected based on the collection request and sent by the mobile terminal; a second information receiving unit, configured to receive a device identifier of the smart lock and identity information of a reservation user corresponding to the device identifier that are sent by a service server, where the identity information of the reservation user is obtained by the service server from a reservation database based on the received device identifier; the device identifier is obtained by the mobile terminal through wireless communication, and is sent to the service server; the reservation database is stored in the service server; a second biometric feature data search unit, configured to identify matching biometric feature information corresponding to the reservation user from a biometric feature database in the processing server by using the identity information of the reservation user; a second user identification unit, configured to perform user identification for the corresponding biometric feature information based on the matching biometric feature information; a second smart lock information acquisition unit, configured to: when the user identification is successful, identify, based on the device identifier, smart lock information corresponding to the device identifier from a smart lock database stored in the processing server; and a second digital key generating and sending unit, configured to generate a digital key for unlocking the smart lock based on the request information and the smart lock information, and send the generated digital key to the mobile terminal.

In some implementations of the present specification, the processing server further includes the following: a second reservation time receiving unit, configured to: when the digital key for unlocking the smart lock is generated based on the request information and the smart lock information, receive a reservation time corresponding to the reservation user that is obtained from the reservation database and sent by the service server; and a second validity period generating unit, configured to determine a validity period of the generated digital key based on the reservation time.

In some implementations of the present specification, the second user identification unit is specifically configured to: when the corresponding biometric feature information is facial feature data and the matching biometric feature information is matching facial feature data, perform feature point matching on the matching facial feature data and the facial feature data to obtain a matching similarity; detect whether the matching similarity is not less than a predetermined threshold, and obtain a detection result; and perform the user identification by using the detection result.

Figure 6:
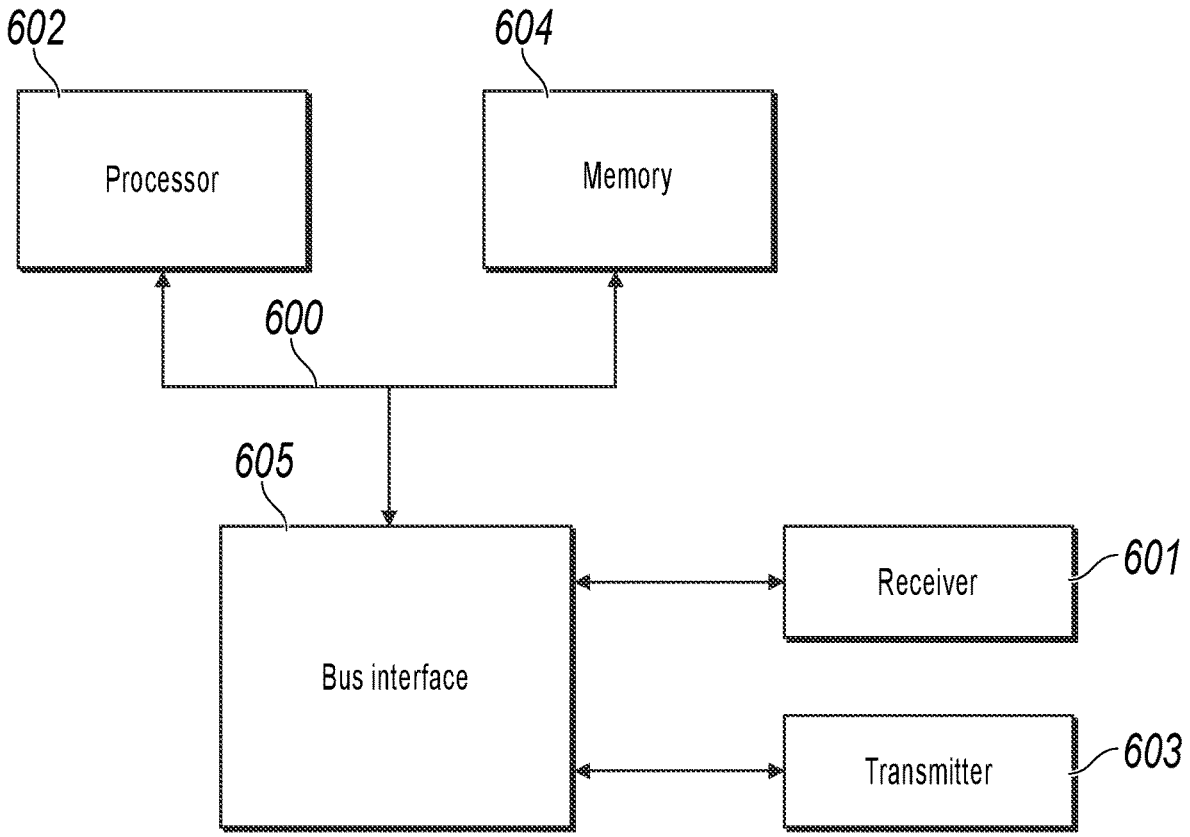
FIG. 6 is a second schematic structural diagram illustrating a mobile terminal, according to some embodiments of the present specification.

According to a tenth aspect, based on the same inventive concept as the smart locks unlocking method in previous embodiments, some embodiments of the present specification further provide a mobile terminal, as shown in FIG. 6, including a memory 604, a processor 602, and a computer program that is stored in the memory 604 and that can be run on the processor 602, where when executing the program, the processor 602 implements steps of any one of the previous smart locks unlocking method.

In FIG. 6, a bus architecture is represented by a bus 600. The bus 600 can include any quantity of interconnected buses and bridges. The bus 600 links various circuits that include one or more processors represented by the processor 602 and one or more memories represented by the memory 604. The bus 600 can further link various other circuits such as a peripheral device, a voltage regulator, and a power management circuit. These are well known in the art, and therefore are not further described in the present specification. A bus interface 605 provides interfaces between the bus 600 and a receiver 601 and a transmitter 603. The receiver 601 and the transmitter 603 can be the same element, namely, a transceiver, which provides a unit configured to communicate with various other apparatuses on a transmission medium. The processor 602 is responsible for management of the bus 600 and general processing. The memory 604 can be configured to store data used when the processor 602 performs an operation.

Figure 7:
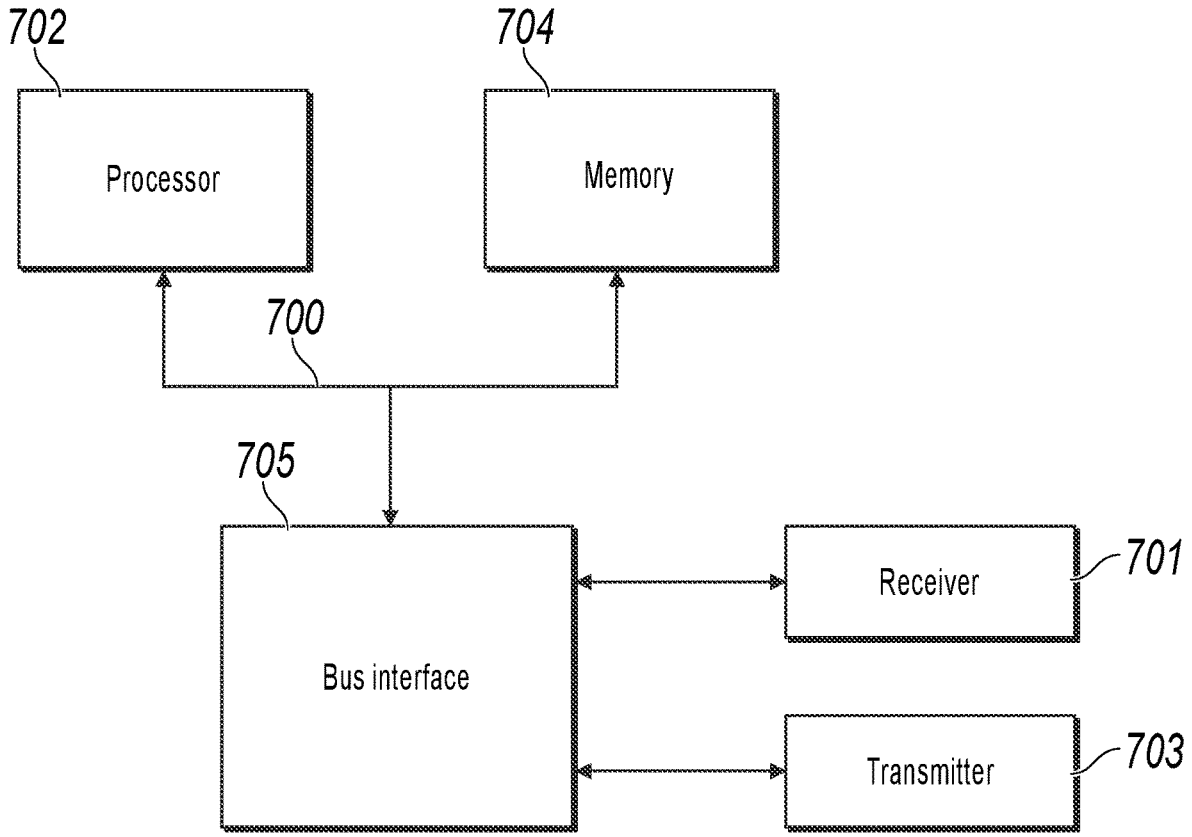
FIG. 7 is a second schematic structural diagram illustrating a processing server, according to some embodiments of the present specification.

According to an eleventh aspect, based on the same inventive concept as the smart locks unlocking method in previous embodiments, some embodiments of the present specification further provide a processing server, as shown in FIG. 7, including a memory 704, a processor 702, and a computer program that is stored in the memory 704 and that can be run on the processor 702, where when executing the program, the processor 702 implements steps of any one of the previous smart locks unlocking method.

In FIG. 7, a bus architecture is represented by a bus 700. The bus 700 can include any quantity of interconnected buses and bridges. The bus 700 links various circuits that include one or more processors represented by the processor 702 and one or more memories represented by the memory 704. The bus 700 can further link various other circuits such as a peripheral device, a voltage regulator, and a power management circuit. These are well known in the art, and therefore are not further described in the present specification. A bus interface 705 provides interfaces between the bus 700 and a receiver 701 and a transmitter 703. The receiver 701 and the transmitter 703 can be the same element, namely, a transceiver, which provides a unit configured to communicate with various other apparatuses on a transmission medium. The processor 702 is responsible for management of the bus 700 and general processing. The memory 704 can be configured to store data used when the processor 702 performs an operation.

According to a twelfth aspect, based on the same inventive concept as the smart locks unlocking method in previous embodiments, some embodiments of the present specification further provide a computer-readable storage medium, where the computer-readable storage medium stores a computer program, and when being executed by a processor, the program implements steps of any one of the previous smart locks unlocking method.

The present specification is described with reference to the flowcharts and/or block diagrams of the method, the device (system), and the computer program product based on some embodiments of the present specification. It is worthwhile to note that computer program instructions can be used to implement each process and/or each block in the flowcharts and/or the block diagrams and a combination of a process and/or a block in the flowcharts and/or the block diagrams. These computer program instructions can be provided for a general-purpose computer, a special-purpose computer, an embedded processor, or a processor of any other programmable data processing device to generate a machine, so that the instructions executed by a computer or a processor of any other programmable data processing device generate a device for implementing a specific function in one or more processes in the flowcharts and/or in one or more blocks in the block diagrams.

These computer program instructions can also be stored in a computer-readable memory that can instruct the computer or any other programmable data processing device to work in a specific way, so that the instructions stored in the computer-readable memory generate an artifact that includes an instruction device. The instruction device implements a specific function in one or more processes in the flowcharts and/or in one or more blocks in the block diagrams.

These computer program instructions can be loaded onto the computer or another programmable data processing device, so that a series of operations and steps are performed on the computer or the another programmable device, thereby generating computer-implemented processing. Therefore, the instructions executed on the computer or the another programmable device provide steps for implementing a specific function in one or more processes in the flowcharts and/or in one or more blocks in the block diagrams.

Although some preferred embodiments of the present specification have been described, a person skilled in the art can make changes and modifications to these embodiments once determining the basic inventive concept. Therefore, the appended claims are intended to be construed as to cover preferred embodiments and all changes and modifications falling within the scope of the present specification.

Clearly, a person skilled in the art can make various modifications and variations to the present specification without departing from the spirit and scope of the present specification. The present specification is intended to cover these modifications and variations provided that they fall within the scope of the claims of the present specification and their equivalent technologies.

What is claimed is:

1. A computer-implemented method for unlocking smart locks, comprising:

sending, by a first server to a mobile device, a biometric feature request to the mobile device;

receiving, by the first server, a biometric feature corresponding to the biometric feature request from the mobile device;

receiving, by the first server, identity information and a device identifier of the smart lock from a second server;

determining, by the first server and based on the identity information, a matching biometric feature stored in a biometric feature database that matches the received biometric feature;

verifying, by the first server, an identity of a user corresponding to the received biometric feature based on the matching biometric feature;

identifying, by the first server after the identity of the user is verified, smart lock information corresponding to the device identifier from a smart lock database;

generating, by the first server, a digital key for unlocking the smart lock based the smart lock information; and sending, by the first server, the digital key to the mobile device.

2. The computer-implemented method of claim 1, wherein the identity information is obtained by the second server from a reservation database based on a user identifier received from the mobile device.

3. The computer-implemented method of claim 1, wherein the digital key has a valid period indicated by the second server.

4. The computer-implemented method of claim 1, wherein the identity information is obtained by the second server from a reservation database based on the device identifier received from the mobile device.

5. The computer-implemented method of claim 4, wherein the device identifier is obtained by the mobile device from the smart lock through wireless communications.

6. The computer-implemented method of claim 1, wherein the biometric feature comprises captured facial features captured by the mobile device, the matching biometric feature comprises matching facial features stored in the biometric feature database, the verifying the identity of the user comprises:

performing, by the first server, feature point matching on the matching facial features and the captured facial features to obtain a matching similarity; and determining, by the first server, whether the matching similarity is greater than or equal to a predetermined threshold.

7. The computer-implemented method of claim 6, wherein the identity of the user is verified when the matching similarity is greater than or equal to the predetermined threshold.

8. A non-transitory, computer-readable medium storing one or more instructions executable by a computer system to perform operations for unlocking smart locks, the operations comprising:

sending, to a mobile device, a biometric feature request to a mobile device;

receiving a biometric feature corresponding to the biometric feature request from the mobile device;

receiving identity information and a device identifier of the smart lock from a server;

determining, based on the identity information, a matching biometric feature stored in a biometric feature database that matches the received biometric feature;

verifying an identity of a user corresponding to the received biometric feature based on the matching biometric feature;

identifying, after the identity of the user is verified, smart lock information corresponding to the device identifier from a smart lock database;

generating a digital key for unlocking the smart lock based on the smart lock information; and sending the digital key to the mobile device.

9. The non-transitory, computer-readable medium of claim 8, wherein the identity information is obtained by the server from a reservation database based on the device identifier received from the mobile device.

10. The non-transitory, computer-readable medium of claim 8, wherein the digital key has a valid period indicated by the server.

11. The non-transitory, computer-readable medium of claim 8, wherein the identity information is obtained by the server from a reservation database based on a user identifier received from the mobile device.

12. The non-transitory, computer-readable medium of claim 11, wherein the device identifier is obtained by the mobile device from the smart lock through wireless communications.

13. The non-transitory, computer-readable medium of claim 8, wherein the biometric feature comprises captured facial features captured by the mobile device, the matching biometric feature comprises matching facial features stored in the biometric feature database, the verifying the identity of the user comprises:

performing feature point matching on the matching facial features and the captured facial features to obtain a matching similarity; and determining whether the matching similarity is greater than or equal to a predetermined threshold.

14. The non-transitory, computer-readable medium of claim 13, wherein the identity of the user is verified when the matching similarity is greater than or equal to the predetermined threshold.

15. A computer-implemented system for unlocking smart locks, comprising:

one or more computers; and one or more computer memory devices interoperably coupled with the one or more computers and having tangible, non-transitory, machine-readable media storing one or more instructions that, when executed by the one or more computers, perform one or more operations comprising:

sending a biometric feature request to a mobile device;

receiving a biometric feature corresponding to the biometric feature request from the mobile device;

receiving identity information and a device identifier of the smart lock from a server;

determining, based on the identity information, a matching biometric feature stored in a biometric feature database that matches the received biometric feature;

verifying an identity of a user corresponding to the received biometric feature based on the matching biometric feature;

identifying, after the identity of the user is verified, smart lock information corresponding to the device identifier from a smart lock database;

generating a digital key for unlocking the smart lock based on the smart lock information; and sending the digital key to the mobile device.

16. The computer-implemented system of claim 15, wherein the identity information is obtained by the server from a reservation database based on a user identifier received from the mobile device.

17. The computer-implemented system of claim 15, wherein the digital key has a valid period indicated by the server.

18. The computer-implemented system of claim 15, wherein the biometric feature comprises captured facial features captured by the mobile device, the matching biometric feature comprises matching facial features stored in the biometric feature database, the verifying the identity of the user comprises:

performing feature point matching on the matching facial features and the captured facial features to obtain a matching similarity; and determining whether the matching similarity is greater than or equal to a predetermined threshold.

19. The computer-implemented system of claim 15, wherein the identity information is obtained by the server from a reservation database based on the device identifier received from the mobile device.

20. The computer-implemented system of claim 19, wherein the device identifier is obtained by the mobile device from the smart lock through wireless communications.

* * * * *